US008308448B2

(12) United States Patent
Fields et al.

(10) Patent No.: US 8,308,448 B2
(45) Date of Patent: Nov. 13, 2012

(54) SCROLL COMPRESSOR CAPACITY MODULATION WITH HYBRID SOLENOID AND FLUID CONTROL

(75) Inventors: Gene Fields, Arkadelphia, AR (US); Joe T. Hill, Arkadelphia, AR (US); Tracy L. Milliff, Arkadelphia, AR (US); Tapesh P. Patel, Hotsprings, AR (US); Harshal R. Upadhye, Charlotte, NC (US); Behzad Parastar, Kolding (DK); Ole Horst Christensen, Kolding (DK)

(73) Assignee: Danfoss Scroll Technologies LLC, Arkadelphia, AR (US)

( * ) Notice: Subject to any disclaimer, the term of this patent is extended or adjusted under 35 U.S.C. 154(b) by 177 days.

(21) Appl. No.: 12/633,258

(22) Filed: Dec. 8, 2009

(65) Prior Publication Data

US 2011/0135509 A1 Jun. 9, 2011

(51) Int. Cl.

| | |
|---|---|
| ***F04B 49/00*** | (2006.01) |
| ***F04B 23/00*** | (2006.01) |
| ***F04B 41/00*** | (2006.01) |
| ***F04B 17/00*** | (2006.01) |

(52) U.S. Cl. ..... 417/310; 417/410.5; 417/440

(58) Field of Classification Search ..... 417/308, 417/310, 410.5, 440; 418/14, 15, 55.1, 55.2, 418/57

See application file for complete search history.

(56) References Cited

U.S. PATENT DOCUMENTS

| | | | | |
|---|---|---|---|---|
| 4,382,370 | A * | 5/1983 | Suefuji et al. | 62/324.1 |
| 4,383,805 | A * | 5/1983 | Teegarden et al. | 417/308 |
| 4,846,633 | A * | 7/1989 | Suzuki et al. | 417/310 |
| 5,336,058 | A * | 8/1994 | Yokoyama | 417/299 |
| 6,478,550 | B2 * | 11/2002 | Matsuba et al. | 417/310 |
| 6,607,367 | B1 * | 8/2003 | Shibamoto et al. | 417/310 |
| 2004/0184923 | A1 * | 9/2004 | Iwanami et al. | 417/221 |

* cited by examiner

*Primary Examiner* — Peter J Bertheaud

(74) *Attorney, Agent, or Firm* — Carlson, Gaskey & Olds, PC

(57) ABSTRACT

A scroll compressor includes a compressor shell having first and second scroll members. The scroll members each have a base and a generally spiral wrap extending from its base. The generally spiral wraps of the first and second scroll members interfit to define compression chambers. A shaft causes the second scroll member to orbit relative to the first scroll member. At least one bypass port is formed in a base of one scroll member, and communicates with at least one of the compression chambers. The bypass port communicates with a passage leading to a suction pressure chamber within the compressor shell. A solenoid valve is movable between a reduced capacity position and a full capacity position, and selectively supplies a pressurized fluid to a fluid valve associated with the bypass port, such that movement of the solenoid can control whether the bypass port is open or closed.

1 Claim, 3 Drawing Sheets

SCROLL COMPRESSOR CAPACITY MODULATION WITH HYBRID SOLENOID AND FLUID CONTROL

BACKGROUND OF THE INVENTION

A scroll compressor is provided with a capacity modulation control, including a solenoid valve which can be moved to selectively control the supply of fluid to bypass valves to move the compressor between a full capacity and a reduced capacity position.

Scroll compressors are becoming widely utilized in refrigerant compression applications. In a scroll compressor, a pair of generally spiral wraps interfit to define compression chambers. One of the wraps is caused to orbit relative to the other, and as the two move, the size of the compression chamber is reduced, thereby compressing an entrapped refrigerant.

Under certain conditions, the capacity, or amount of refrigerant compressed by the compressor, may be desirably reduced. As an example, if the compressor is incorporated into an air conditioning system, and the cooling load is low, then it is more energy efficient to compress less refrigerant.

Various ways are known for reducing the capacity, including moving a valve to selectively open a passage to allow refrigerant to move from a partially compressed location back to suction. However, providing power to these valves has been somewhat challenging.

In particular, when electric valves such as solenoid valves have been utilized to provide capacity control within a scroll compressor, they have been mounted within a hermetically sealed compressor shell. Thus, the valves are exposed to the refrigerant circulating within the shell. The terminals that supply electric power to the valves must then have a hermetically sealed connection. In addition, since the valve is within the shell, it is somewhat difficult to cool the valve, or replace the valve.

It has been proposed to mount such a valve entirely outside of a shell. However, this requires communicating flow passages, which are outside of the shell also, and thus leads to some plumbing challenges.

In co-pending patent application Ser. No. 12/555,037, filed on Sep. 8, 2009, entitled "Scroll Compressor Capacity Modulation With Solenoid Mounted Outside a Compressor Shell," the assignee of the present invention has disclosed and claimed a system wherein a solenoid control for capacity modulation is mounted outside a compressor shell, and has a mechanical component extending through the shell. While this system has great potential, it would be desirable to improve upon the system.

SUMMARY OF THE INVENTION

A scroll compressor includes a compressor shell having first and second scroll members. The scroll members each have a base and a generally spiral wrap extending from its base. The generally spiral wraps of the first and second scroll members interfit to define compression chambers. A shaft causes the second scroll member to orbit relative to the first scroll member. At least one bypass port is formed in a base of one scroll member, and communicates with at least one of the compression chambers. The bypass port communicates with a passage leading to a suction pressure chamber within the compressor shell. A solenoid valve is movable between a reduced capacity position and a full capacity position, and selectively supplies a pressurized fluid to a fluid valve associated with the bypass port, such that movement of the solenoid can control whether the bypass port is open or closed.

These and other features of the present invention can be best understood from the following specification and drawings, the following of which is a brief description.

DETAILED DESCRIPTION OF THE PREFERRED EMBODIMENT

Figure 1:
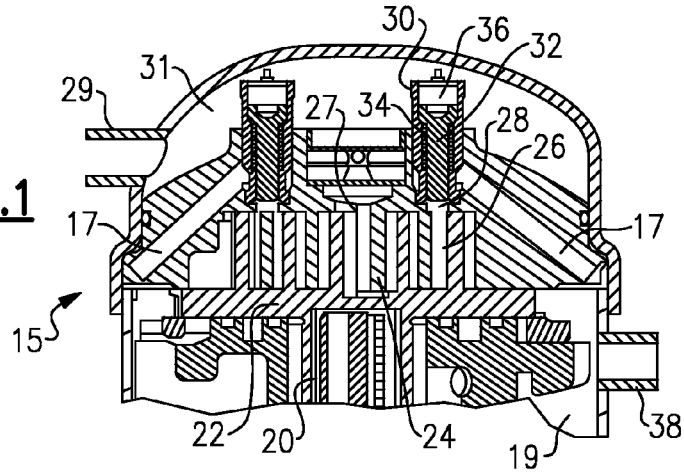
FIG. 1 is a partial cross-sectional view of a first embodiment.

A scroll compressor 15 is illustrated in FIG. 1 having a driveshaft 20 driving an orbiting scroll 22 through a non-orbiting connection, as known. The orbiting scroll 22 orbits relative to a non-orbiting scroll member 24. Wraps on the two scroll members interfit to define compression chambers 26. The compression chambers are reduced in size as the orbiting scroll 22 orbits, and the compression chambers move toward a discharge port 27. From the discharge port 27, discharge pressure refrigerant moves into a discharge plenum 31, and eventually out to a discharge port 29 to a downstream use.

Bypass ports 28 extend through a base of the non-orbiting scroll, and communicate with valve members 32 mounted within valve housings 30. A spring 34 biases the valve members 32 away from the ports 28. When the valve members 32 are biased away, fluid in the compression chambers can move through the ports 28, into passages 17, and back to a suction pressure chamber 19. The suction pressure chamber 19 is also supplied with suction refrigerant from a suction port 38.

As shown, a control chamber 36 biases the valves 32 against the spring force 34.

Figure 2:
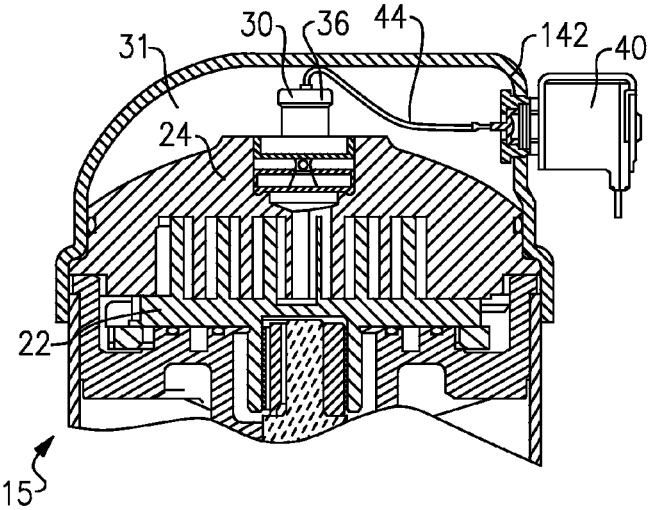
FIG. 2 is a cross-sectional view along a different line within the FIG. 1 embodiment.

As can be appreciated from FIG. 2, a control chamber 36 receives a pressurized fluid through a supply 44 from a solenoid member 40 mounted outside a shell 142. The solenoid includes its electrical connections mounted outside the shell, while a mechanical member moves internally of the shell. This arrangement may be generally as disclosed in the co-pending application Ser. No. 12/555,037, cited above. In the control diagrams of FIGS. 4 and 5, the moving component, which moves against the force of the spring, is within the shell, while the electrical connection is outside of the shell, as shown somewhat schematically by the dashed line for the discharge gas plenum 31. As is clear, the solenoid 40 is mounted on the outside of the pressure shell, while a valving member 203 moves within the compressor shell, which will be described below.

Figure 3:
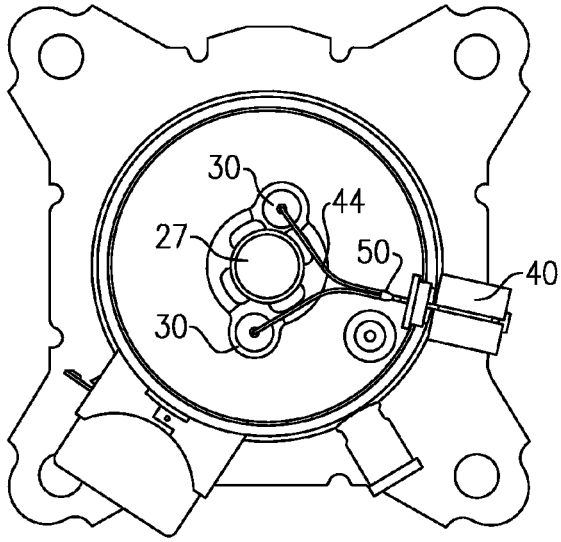
FIG. 3 is a top view of the FIG. 1 embodiment.

As can be appreciated from FIG. 3, the solenoid 40 controls the flow of a pressurized fluid from a pair of lines 44 leading to a pair of valves housings 30, and into the control chambers 36. A valve member 50 acts to open the supply of discharge pressure refrigerant from the chamber 31 to the control chambers 36 should the solenoid 40 fail. In this manner, should the solenoid valve 40 fail, the valves 32 will be biased to a closed position.

At start-up, the solenoid 40 moves valve 203 to a position where it blocks flow of pressurized fluid to the control chambers 36. At this point, the spring 34 may bias the valve 32 away from the port 28, and there is little resistance to start-up due to the reduced capacity. After a period of time, a control sends a signal to the solenoid 40 that increased capacity is desirable. At that time, the solenoid will move to a position such that it supplies pressurized fluid through the lines 44 to the chambers 36. This pressurized fluid may come from the discharge pressure plenum 31, and will act to drive the valve 32 against the force of the spring 34, and close the ports 28. Should it later be determined reduced capacity is in order, then the valves are moved back to the open position.

Figure 4:
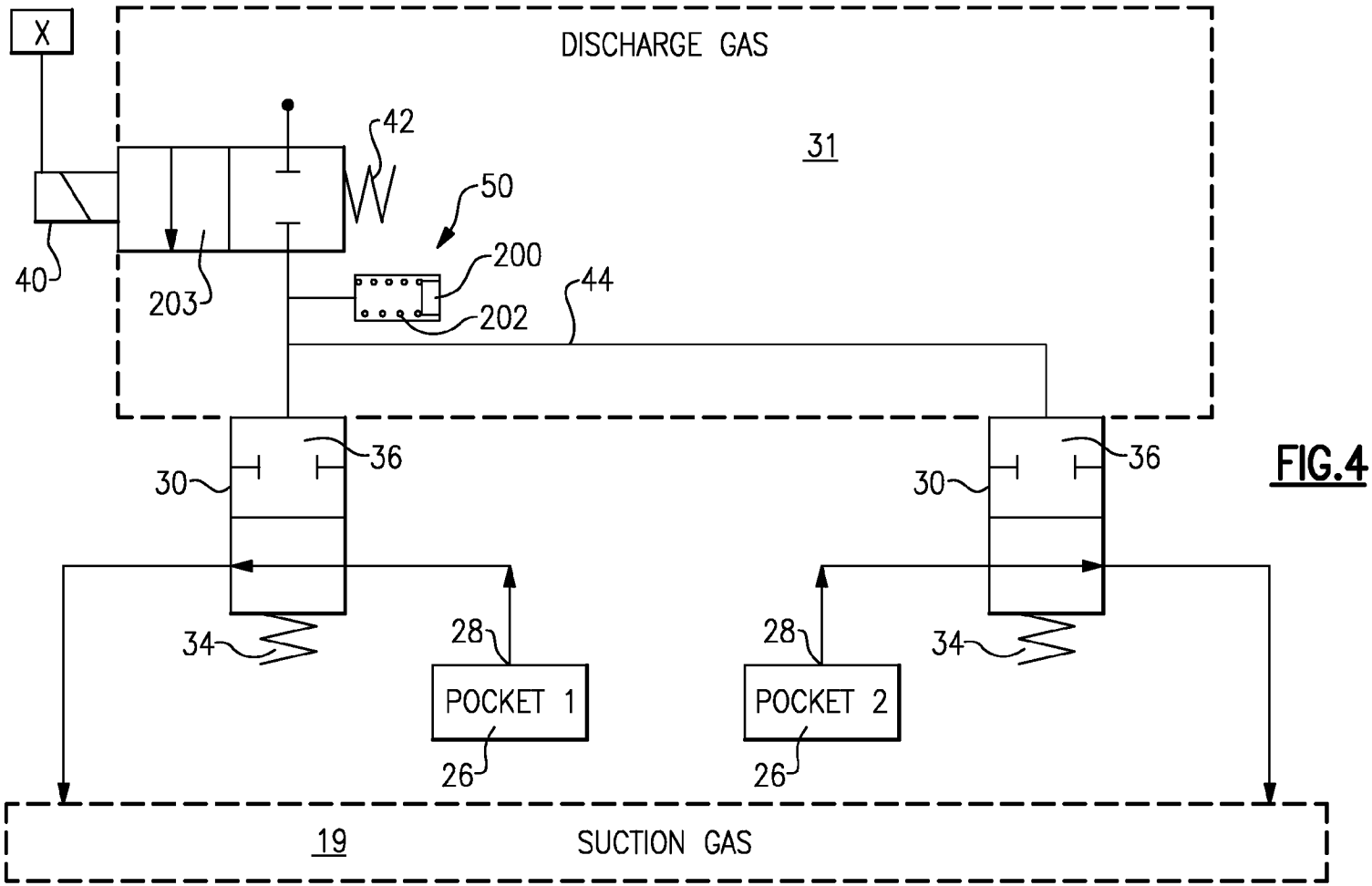
FIG. 4 is a control diagram of a first embodiment.

As shown in FIG. 4, in a first embodiment, a single solenoid has valve 203 that is driven to a position by a spring 42 where it blocks the flow of pressurized refrigerant from the discharge pressure plenum 31 to the control chamber 36 on each of the valve assemblies 30. However, when the solenoid 40 is energized, it will allow the flow of the pressurized fluid to the pressure chambers 36, and this will block the bypass of refrigerant from the compression chambers through the ports 28, and back to the suction plenum 19.

As shown, the valve 50 may be as simple as a valve body including a ball 200 spring biased by spring 202 to a closed position. If the solenoid 40 fails, and once the pressure in the plenum 31 reaches a significantly high level, then the valve 200 will open, and pressurized gas can flow to close the valves 30. Of course, other valve arrangements could be utilized.

The embodiment of FIG. 4 can achieve two steps of capacity. The compressor can supply 100% capacity, or some reduced capacity when both of the ports 28 are opened. Thus, as an example, there may be 100% capacity and 60% capacity available that the control X can achieve by controlling the operation of the solenoid 40.

Figure 5:
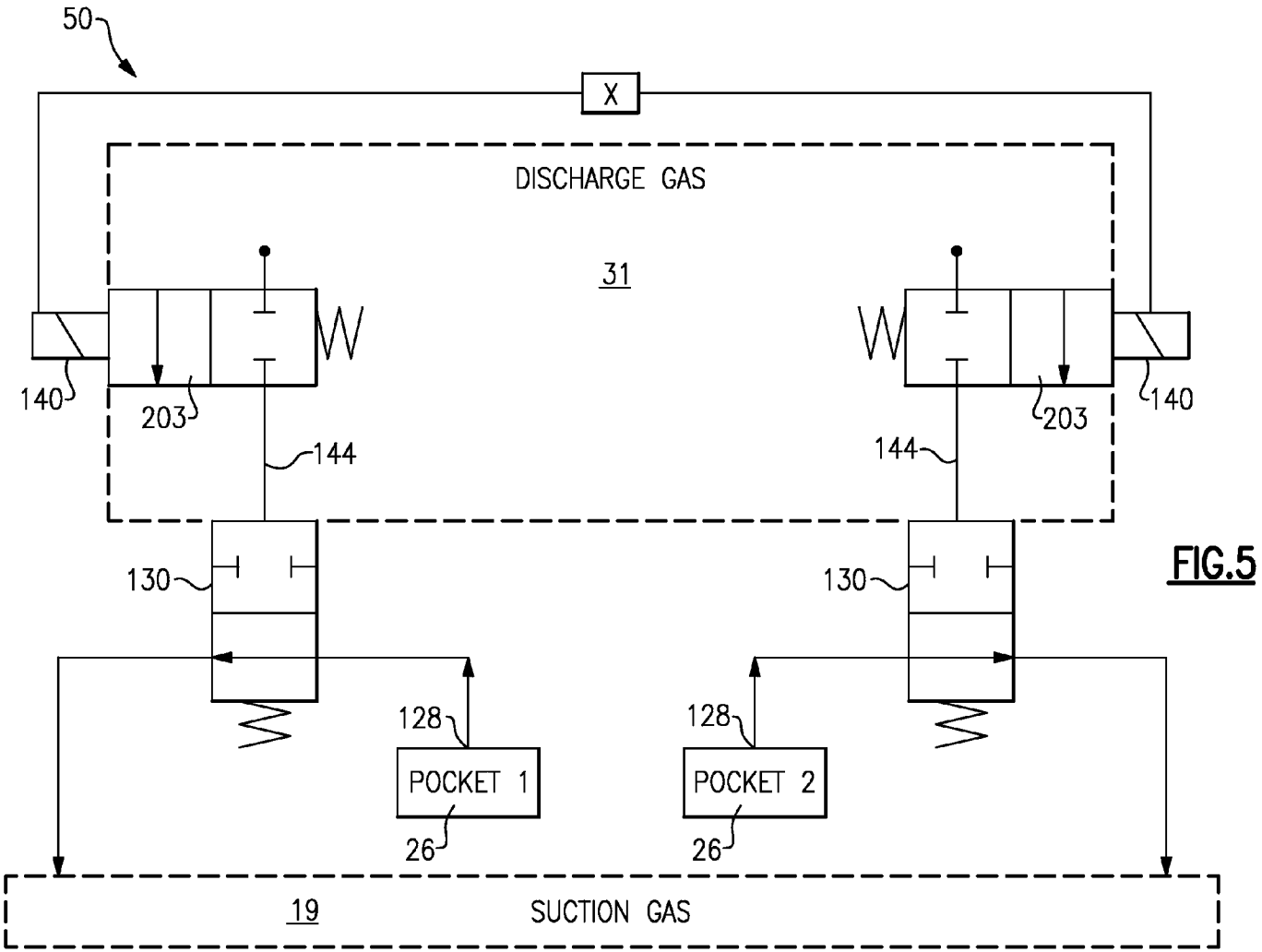
FIG. 5 is a control diagram of a second embodiment.

FIG. 5 shows a second embodiment wherein there are a pair of solenoids 140, each moving valves 203 within a compressor housing and connected to separate valve housings 130 through fluid supply lines 134. A worker of ordinary skill in the art can review the FIGS. 1-3 embodiments, and understand how to mount the solenoids 140, and communicate to the valve housings 130. In this manner, the control X can now achieve three steps of capacity control. Either full capacity can be achieved by closing both valves 130, a first reduced step can be achieved by opening one of the valves, a second step can be achieved by opening both valves. In fact, if the amount of bypass provided by the two separate ports 128 differs, then even a third step of reduced capacity can be achieved. That is, should the left-hand side port 128 reduce capacity by more than the right-hand side port 128, then one could achieve the capacity step of having the left-hand port open, the right-hand port open, or both ports open.

Also, in other embodiments, a single solenoid may be arranged to allow the two valves 130 to be separately open/closed.

Although embodiments of this invention have been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a compressor shell having first and second scroll members, said first scroll member having a base and a spiral wrap extending from its base;

said second scroll member having a base and a spiral wrap extending from its base, said spiral wraps of said first and second scroll members interfitting to define compression chambers;

a suction pressure chamber and a discharge pressure chamber within said compressor shell;

a shaft for causing said second scroll member to orbit relative to said first scroll member;

at least two bypass ports formed in said base of said first scroll member and communicating with at least one of said compression chambers, said at least two bypass ports communicating with respective passages leading to the suction pressure chamber within said compressor shell;

a solenoid valve comprising a solenoid and a valve member movable between a reduced capacity position and a full capacity position, said valve member selectively supplying a pressurized fluid from the discharge pressure chamber to fluid valves associated with said at least two bypass ports, such that movement of the valve member can control whether the at least two bypass ports are open or closed;

said solenoid being mounted onto an outer surface of said compressor shell, having electric components mounted outside of said compressor shell, and receiving an electrical connection which is mounted outside of said compressor shell, said valve member moving within said compressor shell to control the supply of pressurized fluid from the discharge pressure chamber to said fluid valves; and a bypass valve disposed in the discharge pressure chamber; wherein, upon failure of said solenoid valve, said bypass valve opens to allow the supply of pressurized fluid to the fluid valves to ensure that the fluid valves will be held in a position closing said at least two bypass ports.

* * * * *